United States Patent [19]

Renner et al.

[11] 4,114,366

[45] Sep. 19, 1978

[54] DIGITAL BRIGHTNESS CONTROL SYSTEM

[75] Inventors: Karl H. Renner, Dallas; Clark Russell Williams, Plano, both of Tex.

[73] Assignee: Texas Instruments Incorporated, Dallas, Tex.

[21] Appl. No.: 710,524

[22] Filed: Aug. 2, 1976

[51] Int. Cl.[2] ..... G04B 19/30; G04C 3/00; H05B 37/02; H05B 39/04

[52] U.S. Cl. ..... 58/50 R; 58/23 R; 315/156; 340/335

[58] Field of Search ..... 58/23 R, 50 R; 250/214 AL; 340/335, 336, 366 B; 315/156, 159

[56] References Cited

U.S. PATENT DOCUMENTS

| | | | |
|---|---|---|---|
| 3,027,491 | 3/1962 | Seidler | 250/214 AL |
| 3,573,788 | 4/1971 | Molnaz | 340/335 |
| 3,866,406 | 2/1975 | Roberts | 58/58 |
| 3,941,926 | 3/1976 | Slobadzian | 340/335 |

*Primary Examiner*—Edith S. Jackmon

*Attorney, Agent, or Firm*—Rene'E. Grossman; Stephen S. Sadacca

[57] ABSTRACT

A digital light-sensing control system for use in light sensitive equipment, such as a digital watch or a camera, is comprised of light sensor means such as a photo resistor, a digital brightness detector, and brightness control logic. The light sensor means produces analog signals which vary with ambient light intensity. The digital brightness detector selectively digitizes the analog signals to generate digital brightness signals. The brightness control logic generates system control signals in response to the digital brightness signals. Several embodiments of the digital brightness detector and the brightness control logic are disclosed. Each embodiment is capable of being integrated on a single semiconductor substrate.

19 Claims, 8 Drawing Figures

Fig. 1
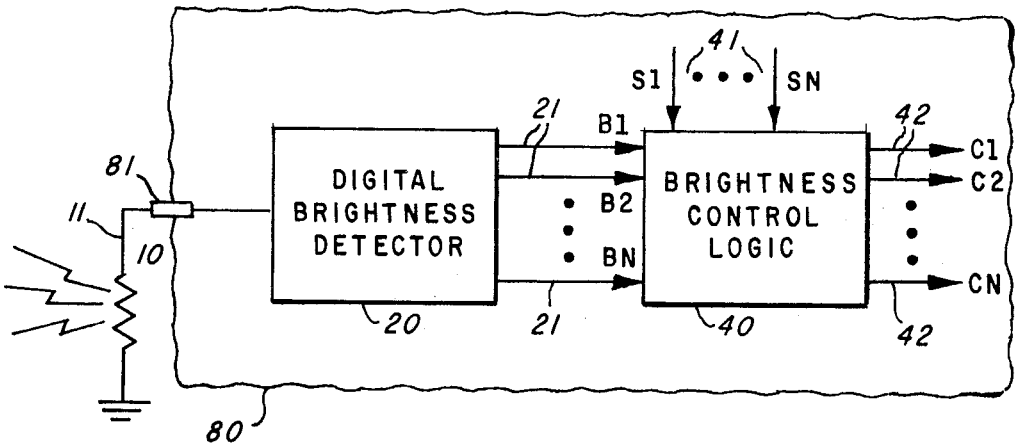
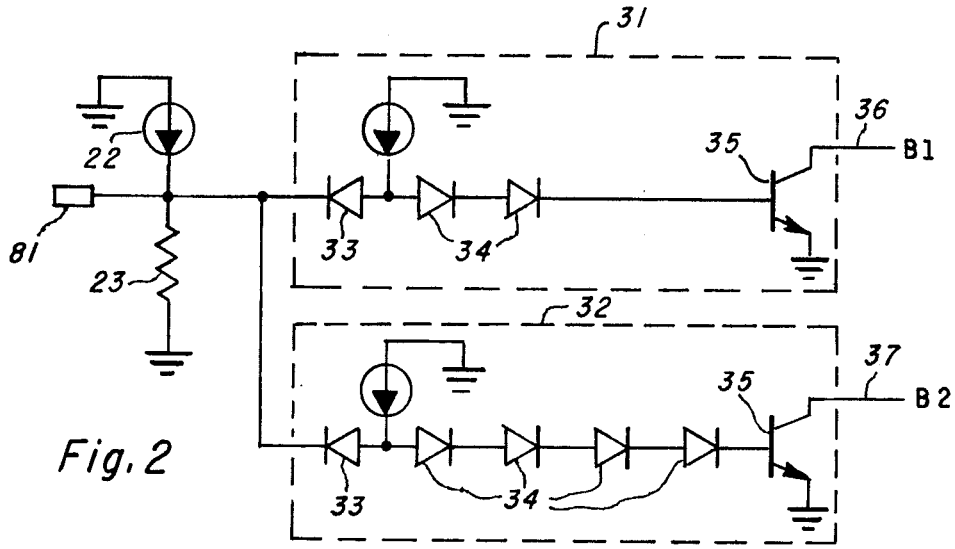
Fig. 2

| AMBIENT LIGHT INTINSITY | PIN 12 VOLTAGE | 46 | 47 |
|---|---|---|---|
| BRIGHT | LESS THAN 1 VOLT | 1 | 1 |
| MEDIUM | BETWEEN 1 AND 2 VOLTS | 0 | 1 |
| DIM | GREATER THAN 2 VOLTS | 0 | 0 |

DIGITAL BRIGHTNESS CONTROL SYSTEM

BACKGROUND OF THE INVENTION

This invention relates to light-sensing control systems for use in light sensitive equipment, and more particularly to improved digital light-sensing control means capable of being fabricated on an integrated circuit.

The field of application for light-sensing control systems is quite extensive. Such systems are used, for example, in electronic digital watches to automatically set the intensity of the LED display in proportion to ambient light intensity, thereby making the LED display easy to read under a variety of lighting conditions, and saving on battery power in medium and dim ambient light. They are also used, for example, in cameras to automatically set shutter speed and/or opening in proportion to surrounding light intensity, thereby eliminating manual settings and the possibility of human error.

In the past, analog light-sensing control systems, operating on R-C time constant principles, were used. In such analog systems, at a selected time, an R-C network is initialized by discharging a timing capacitor; and at a subsequent time, the R-C network is activated by charging the timing capacitor through a timing resistor and a discrete photo resistor. As the ambient light intensity increases, the photo resistor decreases. Therefore, the charging rate of the R-C circuit is a measure of ambient light intensity. Control logic senses the charging rate and, in response, generates system control signals.

An undesirable aspect of analog light-sensing control systems is that in order to provide the required slow charging rate, the timing capacitor and the timing resistor, in addition to the light sensitive resistor, must be implemented with discrete components. This is because the slow charging rate requires a large timing capacitor and a large timing resistor, both such elements requiring too much surface area to be capable of integration onto an integrated circuit chip.

For example, an R-C time constant of 9 milliseconds requires a capacitor of 5000 pF and a resistor of 1.8 million ohms. Metal-oxide-diffusion capacitors use approximately 10 square mils per pF; therefore, a 5000-pF capacitor requires a 50,000-square mil area. In comparison, an integrated circuit chip containing the entire timekeeping circuitry for an electronic watch uses only a 20,000-square mil area.

Capacitors built from a P-N junction require approximately 1 square mil of area per pF, and therefore, use less area than metal-oxide-diffusion capacitors. But 5000-pF capacitors built from a P-N junction are still too large for practical use on an integrated circuit chip, and they also have the undesirable characteristic of varying in capacitive value as the voltage across the P-N junction varies.

Resistors are commonly implemented by utilizing a diffused zig-zag pattern. Each 200 ohms of resistance requires a surface area of approximately 0.3 mils $\times$ 0.7 mils. Therefore, a 9-million ohm resistor requires approximately 1890 square mils of area, which is also prohibitively large when compared to the small 10-square mil area required to implement a logic gate.

Pinch resistors utilize less area, but the ohmic value of a pinch resistor is difficult to control and typically varies by 500%. Pinch resistors are, therefore, not suitable for use in an accurate R-C timing network.

Several difficulties are created by not being able to integrate the timing capacitor and timing resistor onto an integrated circuit chip. The discrete components are much more expensive than components that are integrated onto the lightsensing controller chip. The discrete components also require extra manufacturing steps in the assembly of the control system. In addition, small light-sensitive equipment, such as that employed in an electronic digital watch, has little or no room for discrete parts.

It is, therefore, an object of the present invention to provide an improved light-sensing control system.

Another object of the invention is to provide a light-sensing controller capable of being fabricated as an integrated system having one light-sensitive resistor as its only discrete component.

A further object of the invention is to provide a light-sensing controller which does not require an R-C timing network for its operation.

It is still another object of the invention to provide a digital light-sensing control system.

A still further object of the invention is to provide an electronic timepiece which includes a digital light-sensing means.

BRIEF SUMMARY OF THE INVENTION

These and other objectives are accomplished in accordance with the invention in which a photo resistor is coupled to a digital brightness detector. The resistance of the photo resistor varies inverselyproportional to ambient light conditions. A current source and a load resistor inside the brightness detector generate an analog voltage proportional to the resistance of the photo resistor. Several voltage level detectors inside the digital brightness detector convert the analog voltage into several digital signals. Brightness control logic receives the digital signals and, in response, generates system control signals. The digital brightness detector and brightness control logic are packaged on a single integrated circuit chip.

BRIEF DESCRIPTION OF THE DRAWINGS

The novel features believed characteristic of the invention are set forth in the appended claims; the invention itself, however, as well as other features and advantages thereof, will best be understood by reference to the following detailed description of particular embodiments, read in conjunction with the accompanying drawings, wherein:

FIG. 1 is a block diagram of the invention;

FIG. 2 is a circuit diagram of one embodiment of a digital brightness detector;

DETAILED DESCRIPTION OF THE INVENTION

Figures 3, 4:
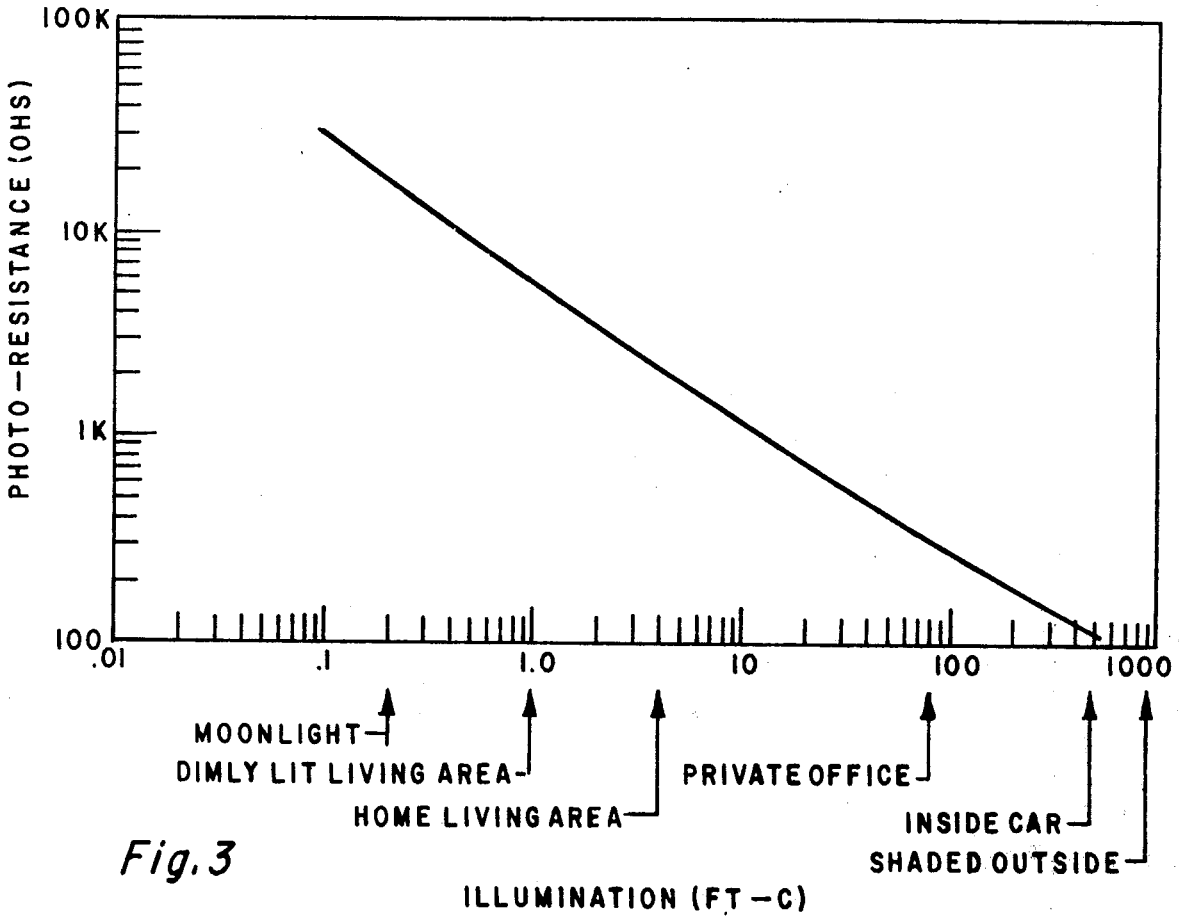
FIG. 3 is a log-log graph of light intensity vs resistance for a photo resistor.
FIG. 4 is a logic truth table of one embodiment of a digital brightness detector.

Referring then to FIG. 1, a block diagram of an embodiment of the invention is illustrated. The embodiment is comprised of photo resistor 10, digital brightness detector 20, and brightness control logic 40. Photo resistor 10 is a discrete component, while digital brightness detector 20 and brightness control logic 40 are capable of being integrated onto a signal semiconductor circuit chip 80. Electrical contact is made between photo resistor 10 and semiconductor chip 80 by means of input signal lead 11 connected to input lead 81.

Digital brightness detector 20 converts analog signals formed on input lead 81 to a plurality of digitized brightness signals B1-BN on leads 21. Brightness control logic 40 receives digitized brightness signals B1-BN, combines them with system input signals S1-SN on leads 41, and produces system control signals C1-CH on lead 42.

Referring to FIG. 2, a circuit diagram of an embodiment of digital brightness detector 20 is illustrated. Input pin 81 is coupled to a current source 22 and shunt load resistor 23. Current source 22 has a constant current output of, for example, 140 μa. Therefore, the voltage on pin 81 equals 140 μa times the resistance of shunt load resistor 23 in parallel with photo resistor 10.

The resistance of photo resistor 10 is inversely proportional to ambient light intensity raised to a power, as graphically illustrated in FIG. 3. For example, photo resistor 10 has a resistance of approximately 300 ohms in an ambient light of 80 foot-candles, and has a resistance of approximately 20,000 ohms in an ambient light of 0.2 foot-candles. The former light intensity approximates normal office lighting conditions, and the latter light intensity approximates moonlight.

since the resistance of photo resistor 10 varies inversely with light intensity, and since current source 22 has a non-varying output, the amplitude of the voltage on input pin 81 is a measure of light intensity. The use of voltage amplitude, as opposed to R-C charge time, to measure light intensity eliminates the need for a charging capacitor or a charging resistor; and is an important feature of the invention.

Input pin 81 is coupled to the input nodes of two voltage level detectors 31 and 32. Each voltage level detector is comprised of an input diode 33, a predetermined number of serially-connected threshold setting diodes 34, and an output transistor 35.

Detector 31 generate a digital output signal B1. Signal B1 is in a logical "1" state whenever the voltage on input pin 81 is less than about one volt, and is in a logical "0" state whenever the voltage on pin 81 is greater than about one volt. The actual voltage at which detector 31 switches is equal to the cut-in voltage of one threshold setting diode 34 plus the cut-in voltage of a respective transistor 35.

Similarly, detector 32 generates a digital brightness output signal B2 on lead 37. Signal B2 is in a logical "1" state whenever the voltage on input pin 81 is less than about two volts, and is in a logical "0" state whenever the voltage on pin 81 is greater than about two volts. The actual threshold level of detector equals three times the cut-in voltage of one threshold setting diode 34 plus the cut-in voltage of a respective transistor 35.

The light intensity corresponding to two volts on input pin 81 is labeled as "medium," and the light intensity corresponding to one volt is labeled as "bright." Thus, the digital brightness detector of FIG. 2 behaves according to the truth table of FIG. 4. Any number of level detectors, each having a unique switching threshold, could be used in the digital brightness detector in order to more finely quantize the ambient light intensity. The ability to easily quantize the ambient light to any desired degree is another feature of the invention.

Figure 5:
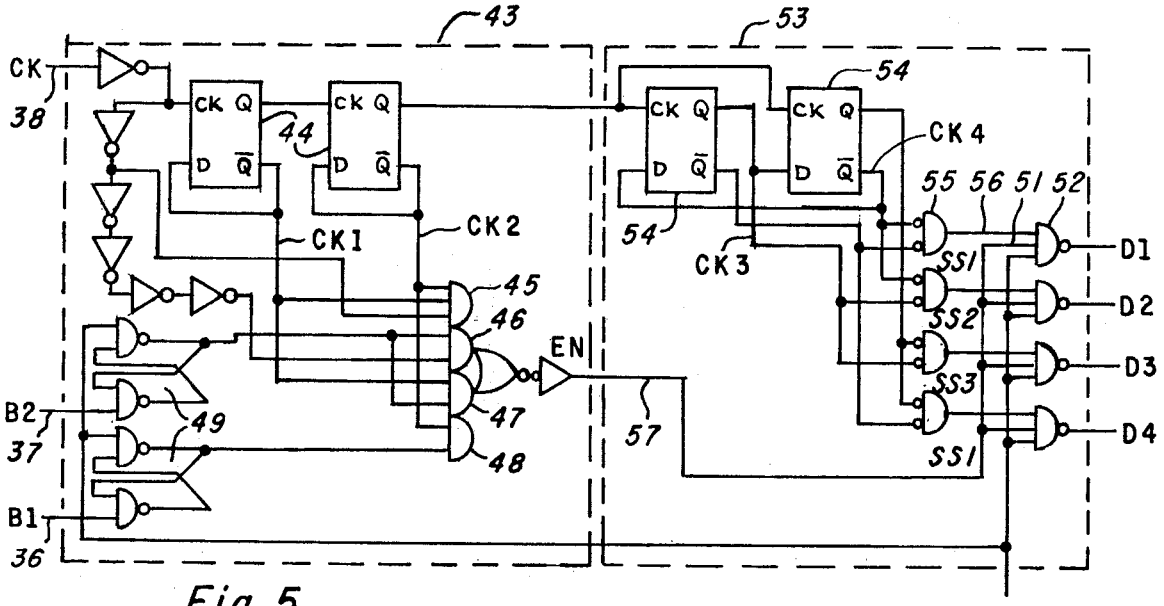
FIG. 5 is a logic diagram of one embodiment of the brightness control logic.

Referring to FIG. 5, a logic diagram of an embodiment of the brightness control logic of FIG. 1 is illustrated. This embodiment of the control logic is used, for example, in an electronic watch to automatically adjust the LED intensity to one of three settings in response to varying ambient light conditions conditions that are classified as "dim," "medium" or "bright." The embodiment is comprised of a signal generator 43, and a LED scanner 53.

The purpose of signal generator 43 is to generate an enabling signal En on lead 57. Signal En has a pulse width proportional to ambient light intensity. The operation of signal generator 43 is best understood by referring to the timing diagram of FIG. 6 in conjunction with FIG. 5. A clock signal Ck, of fixed frequency, is applied to counter 44 via lead 38. Counter 44 divides the input frequency by two and by four. The resultant signals Ck1 and Ck2, respectively, are combined with signal Ck to form enabling signal En.

Signal En has three different pulse widths, which depend upon the state of signals B1 and B2. When signals B1 and B2 are both a logical "0", only gate 45 is activated; and therefore, signal En has a relatively small pulse width 70. When signal B1 is a logical "0", and signal B2 is a logical "1", gates 45, 46 and 47 are activated; and therefore, signal En has a medium pulse width 71. Finally, when signals B1 and B2 are both a logical "1", gates 45, 46, 47 and 48 are activated; and therefore, signal En has a relatively long pulse width 72. Latches 49 are included at inputs 36 and 37 to avoid "flickering" effects whenever the voltage on pin 81 is near the threshold of one of the voltage level detectors.

These three different pulse widths 70, 71, and 72 of signal En are used to obtain three distinct LED intensities in an electronic watch. By activating an LED only when enabling signal En is in a logical "1" state, three distinct intensities result, because the amount of light emitted by an LED is proportional to the length of time it is activated. Signal En, therefore, is applied to one LED control input lead 51 of each LED driver 52 in the watch. The exact number of LED drivers 52 depends on the number of display characters of the particular watch design, and is typically from two to six.

Figure 6:
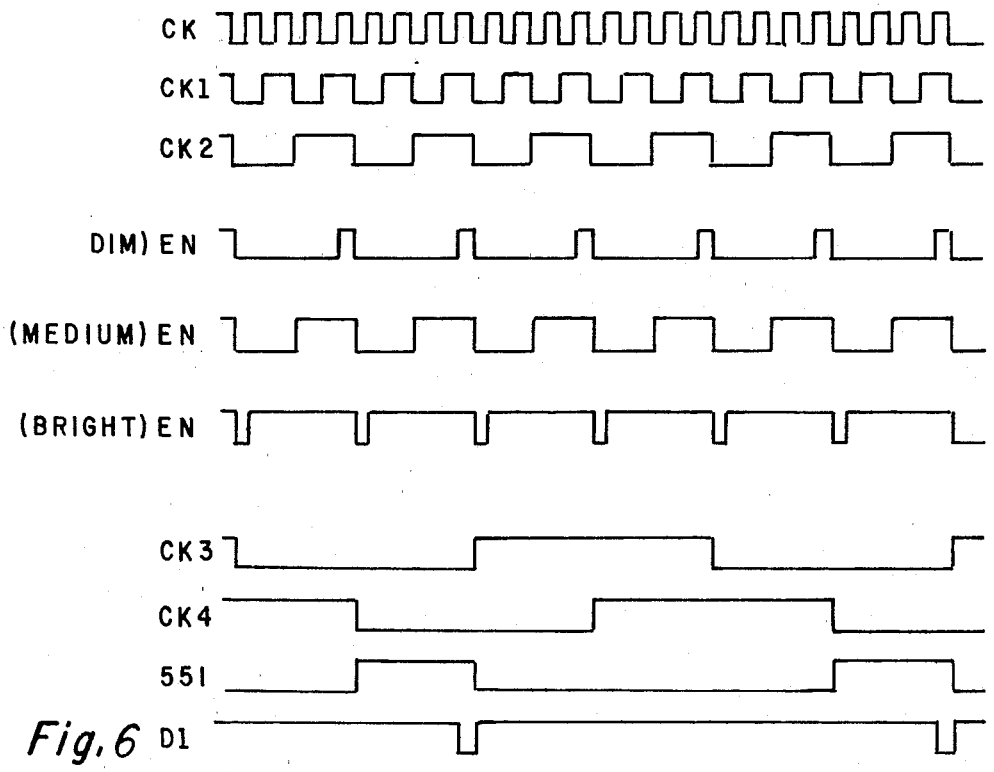
FIG. 6 is a timing diagram illustrating the logic signals of various nodes within the logic of FIG. 5.

The above embodiment of brightness control logic 40 further includes an LED scanner 53. The purpose of scanner 53 is to multiplex the display by sequentially providing individual LED select signals 66 to each LED driver 52. Scanner 53 accomplishes this purpose by further dividing down input clock signal Ck by means of a counter means 54 until the desired scanning frequency is reached; and by logically ANDing the resultant signal Ck3 and Ck4 by means of logic gates 55 to obtain sequential select signals SS1-SS4 and by applying these signals to LED drivers 52 via LED control inputs 56. By this technique, the scanning rate can be made very slow, and at the same time, it is independent of any large R-C charging time constant which requires physically large components for implementation. LED driver output signal D1, as shown in FIG. 6, illustrates a scanning rate under conditions where enabling signal En has a short pulse width 70.

Figure 7:
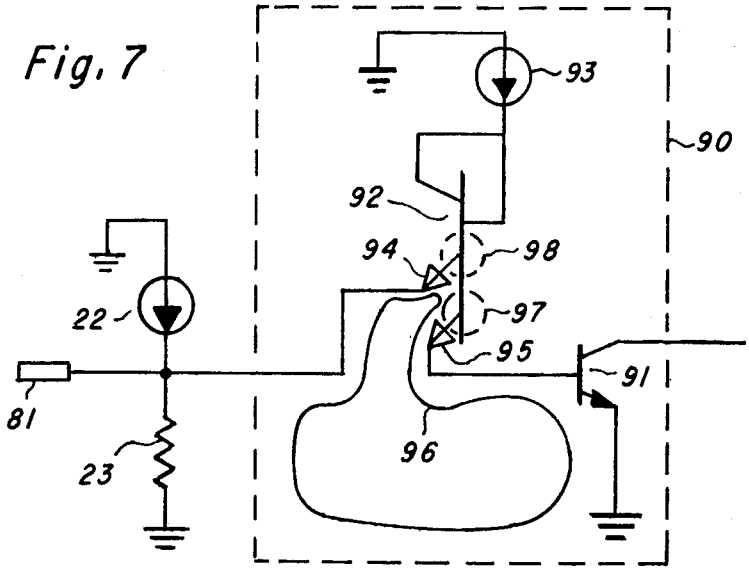
FIG. 7 is a circuit diagram of another embodiment of a digital brightness detector.

As previously pointed out, the ambient light on photo resistor 10 can be quantized differently simply by using voltage level detectors having other unique thresholds. Referring to FIG. 7, a voltage level detector 90 having a threshold of approximately 500 mV is illustrated.

Level detector 90 consists of an output transistor 91, a multi-emitter transistor 92, and a current source 93. One emitter 94 of multi-emitter transistor 92 is coupled to input pin 81, and another emitter 95 is coupled to the base of output transistor 91. Base current source 93 is coupled to the base and collector of transistor 92. Current source 93 has a small output current relative to the output of current source 22 so as not to affect the voltage level on pin 81.

The operation of level detector 90 is best understood by considering how the current flows through emitters 94 and 95 in response to various voltages on input pin 81. When the voltage on input pin 81 is near ground, almost all of the current from current source 93 flows through emitter 94, and therefore, output transistor 91 turns off. As the voltage on input pin 81 rises, current through emitter 94 decreases and current through emitter 95 increases. When the current emitters 94 and 95 are approximately equal, output transistor 91 turns on.

The threshold voltage of level detector 90 is calculated by summing voltage drops around a loop 96, under the condition where the current through emitters 94 and 95 are equal. Therefore, the threshold voltage equals the cut-in voltage drop of output transistor 91 plus the voltage drop across base-emitter junction 98. But the latter two voltage drops are equal when the current through emitters 94 and 95 are equal. Therefore, the threshold voltage of level detector 90 equals the cut-in voltage of output transistor 91. At low current levels, this is approximately 500 mV.

Figure 8:
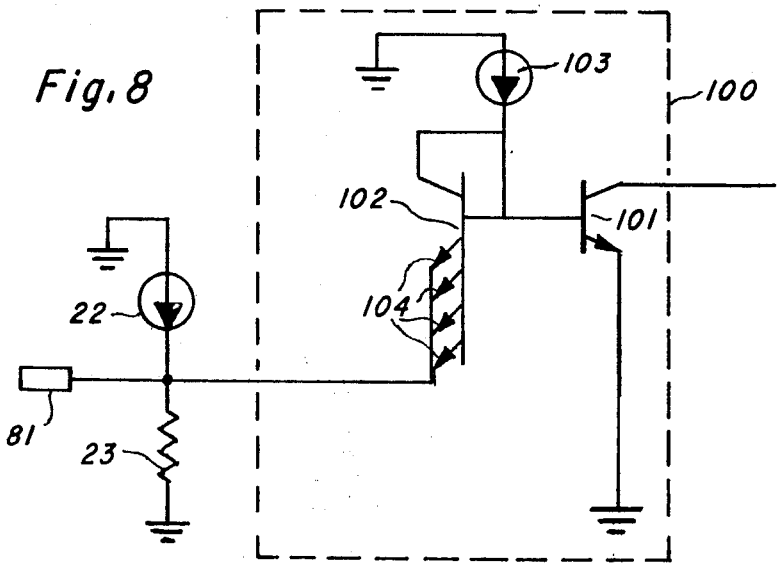
FIG. 8 is a circuit diagram of still another embodiment of a digital brightness detector.

Referring to FIG. 8, a circuit diagram of a voltage level detector 100, having a threshold of approximately 60 mV, is illustrated. Level detector 100 is comprised of an output transistor 101, a multi-emitter transistor 102, and a current source 103. All the emitters 104 of transistor 102 are coupled to input pin 81. Typically, transistor 104 has 10 emitters. The base and collector of transistor 102 are coupled to the base of output transistor 101 and to current source 103.

When the voltage on input pin 81 is near ground, the voltage drop across each base-emitter junction of transistor 102 equals the voltage drop across the base-emitter junction of output transistor 101. Therefore, each junction draws an equal amount of current. For example, if transistor 102 has ten emitters, then approximately 10/11 of the current from current source 103 passes through transistor 102; and only 1/11 of the current passes through transistor 101. Therefore, transistor 101 will be turned off.

As the voltage on input pin 81 rises, the current through the base-emitter junction of transistor 102 decreases, and the current through the base-emitter junction of transistor 101 increases. Output transistor 101 turns on when the current through its base-emitter junction equals the total current passing through all of the base emitter junctions of transistor 102. For example, if transistor 102 has 10 emitters, then each base-emitter junction of transistor 102 has 1/10 the current of the base-emitter junction of transistor 101 when transistor 101 turns on.

The threshold voltage of level detector 100 equals the base-emitter voltage drop of transistor 101 minus the base-emitter voltage drop of transistor 102 under the above-described current-sharing conditions. And since current and voltage through a base-emitter junction are approximately related by the ideal diode equation $$I_{BE} = Io\left(e^{\frac{q\,V_{BE}}{kT}} - 1\right),$$

this threshold voltage may be expressed in terms of current through each base-emitter junction. For example, if transistor 102 has 10 emitters, then under the above current-sharing condition, the threshold voltage is approximately $(kT/q)$ ln 10, which equals approximately 60 mV.

Various embodiments of the invention have now been described in detail. Since it is obvious that many changes and modifications can be made in the above details without departing from the nature and spirit of the invention, it is understood that the invention is not to be limited to said details except as set forth in the appended claims.

What is claimed is:

1. An electronic digital timekeeping device comprising:

(a) time display means;

(b) timekeeping circuitry means coupled to said display means for generating time signals for display by said display means;

(c) light sensor means;

(d) digital brightness detector means coupled to said light sensor means, said detector means including:

(i) a current source means, and (ii) a plurality of semiconductor voltage level detector means with each of said voltage level detector means having an analog input coupled to said current source means, a unique switching threshold, and a digital output representative of the quantum of light detected by said light sensor means; and (e) brightness control logic means coupled to said detector means for controlling the brightness of said display according to the digital outputs of said plurality of voltage level detector means.

2. An electronic digital timekeeping device according to claim 1 wherein said brightness control logic means is comprised of a signal generator and a LED scanner; said signal generator having an output signal with a pulse width reflecting the state of said digital brightness output signals, and said LED scanner selectively applying said output of said signal generator to a plurality of LED drivers.

3. An electronic digital timekeeping device according to claim 1 wherein said plurality of semiconductor voltage level detector means and said digital brightness control logic is integrated on a single semiconductor chip.

4. An electronic digital timekeeping device according to claim 3, wherein at least some of said level detector means are comprised of a bipolar output transistor having a base coupled to a current source by means of at least one seriallyconnected threshold setting diodes; said base current source being coupled to said analog input by means of an input diode.

5. An electronic digital timekeeping device according to claim 3 wherein at least some of said level detector means are comprised of a bipolar output transistor having a base coupled to one emitter of a multiple emitter transistor; said multiple emitter transistor having at least one emitter coupled to said analog input and having a base and a collector both coupled to a current source.

6. An electronic digital timekeeping device according to claim 3 wherein at least some of said level detector means are comprised of a bipolar output transistor having a base coupled to a current source and to a collector and a base of a multiple emitter transistor; each emitter of said multiple emitter transistor being coupled together and to said analog input.

7. A digital light-sensing control system comprising:

(a) light sensor means for varying an analog electrical signal according to light intensity;

(b) digital brightness detector means including regulated electrical signal source means and a plurality of level detector means coupled to said regulated electrical signal source, and to said light sensor means; each of said level detector means having an analog input and a unique switching threshold, for generating a digital brightness output signal; and (c) brightness control logic means, coupled to said digital brightness detector means for selectively generating a plurality of system control signals in response to said digital brightness signals.

8. A digital light-sensing control system according to claim 7 wherein said light sensor means is a photo resistor.

9. A digital light-sensing control system according to claim 7 wherein said brightness control logic and said digital brightness detector are integrated on a single semiconductor chip.

10. A digital light-sensing control system according to claim 7 wherein said regulated electrical signal source means is comprised of a semiconductor constant current source and a shunt load resistor.

11. A digital light-sensing control system according to claim 7 wherein said brightness control logic means is comprised of a signal generator and a LED scanner; said signal generator having an output signal with a pulse width reflecting the state of said digital brightness output signals, and said LED scanner selectively applying said output of said signal generator to a plurality of LED drivers.

12. An integrated digital light-sensing control system comprising:

(a) a photo resistor;

(b) semiconductor current source means, coupled to said photo resistor, for generating a voltage proportional to the resistance of said photo resistor;

(c) a plurality of semiconductor voltage level detecting means coupled to said current source means, each level detecting means of said plurality providing an analog input, a digital output, and a unique switching threshold; and (d) brightness control logic means, coupled to each of said digital outputs, for generating system control signals in response to said digital outputs.

13. An integrated digital light-sensing control system according to claim 12 wherein at least some of said level detector means are comprised of an output transistor having a base coupled to a current source through at least one serially-connected threshold setting diodes; said base current source being coupled to said analog input through an input diode.

14. An integrated digital light-sensing control system according to claim 12 whrein at least some of said level detector means are comprised of an output transistor having a base coupled to one emitter of a multiple emitter transistor; said multiple emitter transistor having at least one emitter coupled to said analog input and having a base and a collector both coupled to a current source.

15. An integrated digital light-sensing control system according to claim 12 wherein at least some of said level detector means are comprised of an output transistor having a base coupled to a current source and to a collector and a base of a multiple emitter transistor; each emitter of said multiple emitter transistor being coupled together and to said analog input.

16. An electronic digital timekeeping device comprising a case, time display means, timekeeping circuitry, and a light sensor means enclosed within said case; with at least some of said timekeeping circuitry being integrated on a single semiconductor chip; wherein said single chip contains digital brightness detector means and brightness control logic means for varying the intensity of said time display means in response to ambient light intensity detected by said light sensor means, said digital brightness detector means being comprised of a plurality of semiconductor voltage level detector means coupled to a current source means; each level detector means of said plurality providing an analog input, a digital output that is responsive to said analog input, and a unique switching threshold.

17. An electronic digital timekeeping device according to claim 16 wherein at least some of said level detector means are comprised of a bipolar output transistor having a base coupled to a current source by means of at least one serially-connected threshold setting diodes; said base current source being coupled to said analog input by means of an input diode.

18. An electronic digital timekeeping device according to claim 16 wherein at least some of said level detector means are comprised of a bipolar output transistor having a base coupled to one emitter of a multiple emitter transistor; said multiple emitter transistor having at least one emitter coupled to said analog input and having a base and a collector both coupled to a current source.

19. An electronic digital timekeeping device according to claim 16 wherein at least some of said level detector means are comprised of a bipolar output transistor having a base coupled to a current source and to a collector and a base of a multiple emitter transistor each emitter of said multiple emitter transistor being coupled together and to said analog input.

* * * * *